US005622226A

United States Patent [19]

Hausman et al.

[11] Patent Number: 5,622,226

[45] Date of Patent: Apr. 22, 1997

[54] METHOD FOR CONTROLLING BOUNCE OF A WORK IMPLEMENT

[75] Inventors: Dennis J. Hausman, Peoria; John J. Krone, Dunlap; Michael I. Cline, Metamore, all of Ill.

[73] Assignee: Caterpillar Inc., Peoria, Ill.

[21] Appl. No.: 593,023

[22] Filed: Jan. 29, 1996

[51] Int. Cl.[6] ..... A01C 5/00; A01B 63/112

[52] U.S. Cl. ..... 172/4.5; 172/7; 172/12; 364/424.07

[58] Field of Search ..... 37/347, 348; 111/101, 111/102, 103, 104, 52; 172/3, 4, 4.5, 6, 7, 9, 12; 364/424.05, 424.07

[56] References Cited

U.S. PATENT DOCUMENTS

| | | | |
|---|---|---|---|
| 4,084,641 | 4/1978 | Ashfield et al. | 172/9 |
| 4,157,118 | 6/1979 | Suganami et al. | 172/7 X |
| 4,427,075 | 1/1984 | Romes | 172/7 |
| 4,463,658 | 8/1984 | Heiser et al. | 172/7 X |
| 4,571,500 | 2/1986 | Macheyer | 172/7 X |
| 5,143,159 | 9/1992 | Young et al. | 172/7 X |
| 5,152,347 | 10/1992 | Miller | 172/7 |
| 5,499,683 | 3/1996 | Bassett | 172/4 |

OTHER PUBLICATIONS

"System Type KT For Cat", Hydroscand, Ledningskomponenter For Hydraulik, Sweden. (May 1990).

*Primary Examiner*—Terry Lee Melius
*Assistant Examiner*—Robert Pezzuto
*Attorney, Agent, or Firm*—J. W. Burrows

[57] ABSTRACT

A method is provided for controlling the bounce of a work implement attached to a machine having an electro-hydraulic system. The method comprises the steps of sensing the operating pressure in an actuator arrangement connected between the frame of the machine and the work implement, monitoring an upper and a lower operating pressure level in the actuator arrangement to establish a threshold pressure level and altering the pressure level in the actuator arrangement in the event the threshold level is exceeded to re-establish the threshold pressure level. Once the original threshold level is attained, the system is reset. This effectively eliminates the bounce of the work implement at the initial onset of the bounce and resets the system to react to future bounces.

12 Claims, 2 Drawing Sheets

METHOD FOR CONTROLLING BOUNCE OF A WORK IMPLEMENT

TECHNICAL FIELD

This invention relates generally to the control of a work implement attached to a machine and more particularly to eliminating the bouncing of a work implement during use.

BACKGROUND ART

In many machines, such as motorgraders, when the blade or work implement is being used to grade a road surface, the machine may begin to lope or bounce. This results in the road surface being scalloped or rough resulting in the need to rework the road surface a second or more times. This is generally attributed to the fact that the actuators are locked in position and cannot move up or down. In known machines, it is generally the practice for the operator to raise the blade, change the blade angle or reduce the machine speed once he detects the bounce. However, by the time the operator detects the bounce, a large area has already been affected. It is desirable to detect and provide corrective measures at the initial onset of the bounce.

The subject invention is directed to overcoming one or more of the problems as set forth above.

DISCLOSURE OF THE INVENTION

In one aspect of the present invention, a method is provided for controlling the bounce of a work implement attached to a machine having an electro-hydraulic system. The electro-hydraulic system includes a microprocessor, an actuator arrangement connected between the machine and the work implement, a source of pressurized fluid that receives fluid from a reservoir, an electro-hydraulic directional control valve disposed between the source of pressurized fluid and the actuator, and a control lever electrically connected to the microprocessor and operative to control movement of the electro-hydraulic directional control valve. The method includes the steps of detecting the initiation of a bounce and altering the pressure level in the actuator arrangement to eliminate the bounce.

The present invention provides a method that automatically controls the bounce in a work implement at the initial onset of the bounce by altering the pressure within the actuator to maintain a minimum threshold peak to peak pressure level thus controlling the operating force therein.

BEST MODE FOR CARRYING OUT THE INVENTION

Figure 1:
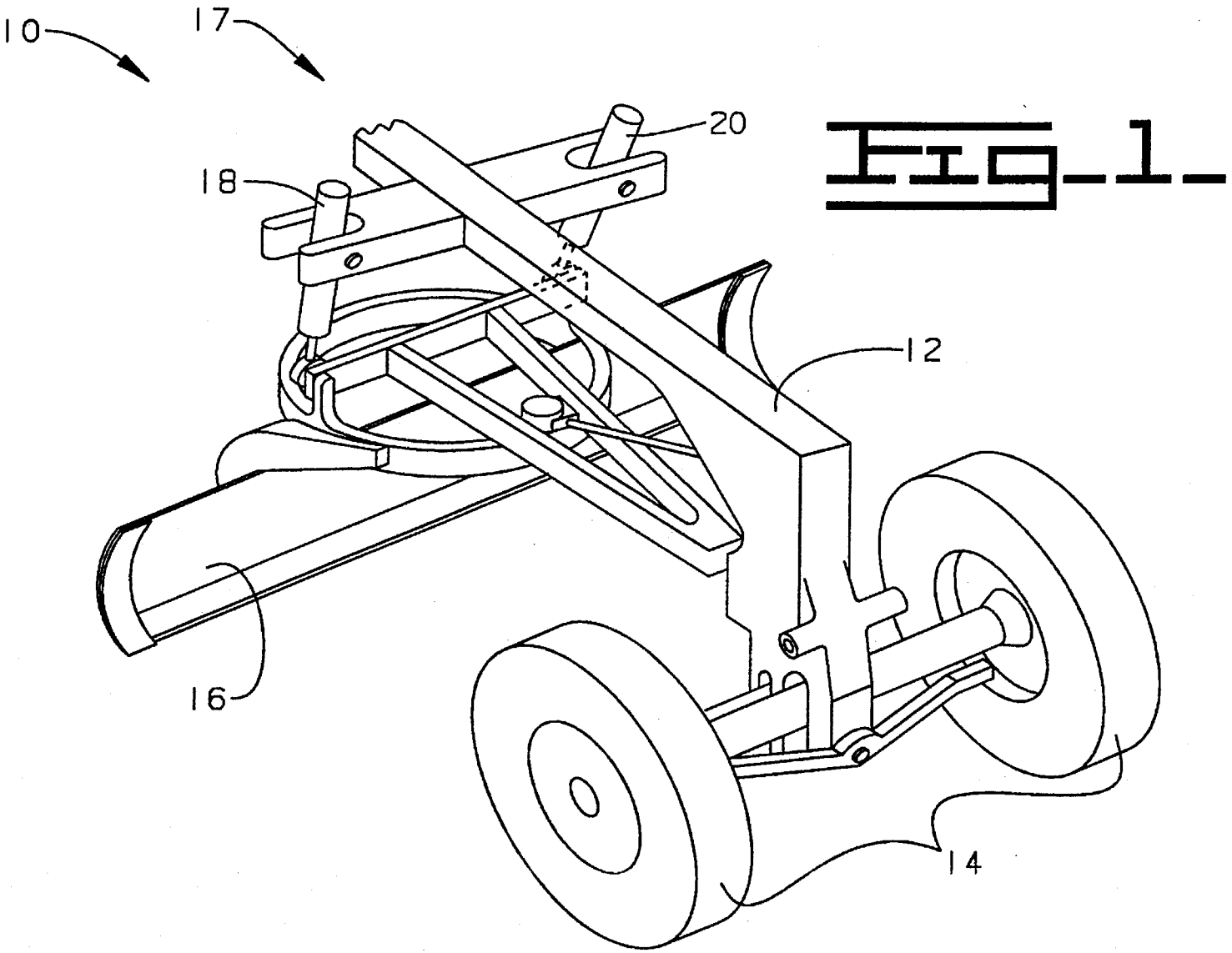
FIG. 1 is a diagrammatic illustration of a portion of a machine that utilizes the subject invention.

Referring to FIG. 1 of the drawings, a front portion of a machine, such as a motorgrader 10, is illustrated. The front portion of the motorgrader 10 includes a frame 12, a pair of steerable front wheels 14 connected to the frame 12, a single work member, such as a blade 16, and an actuator arrangement 17, such as first and second actuators 18,20, connected between the frame 12 and the blade 16. Each of the first and second actuators 18,20 has a head end 22 and a rod end 23.

It is recognized that the use of the term actuator arrangement used herein could mean one, two or more actuators even though two are illustrated and described.

Figure 2:
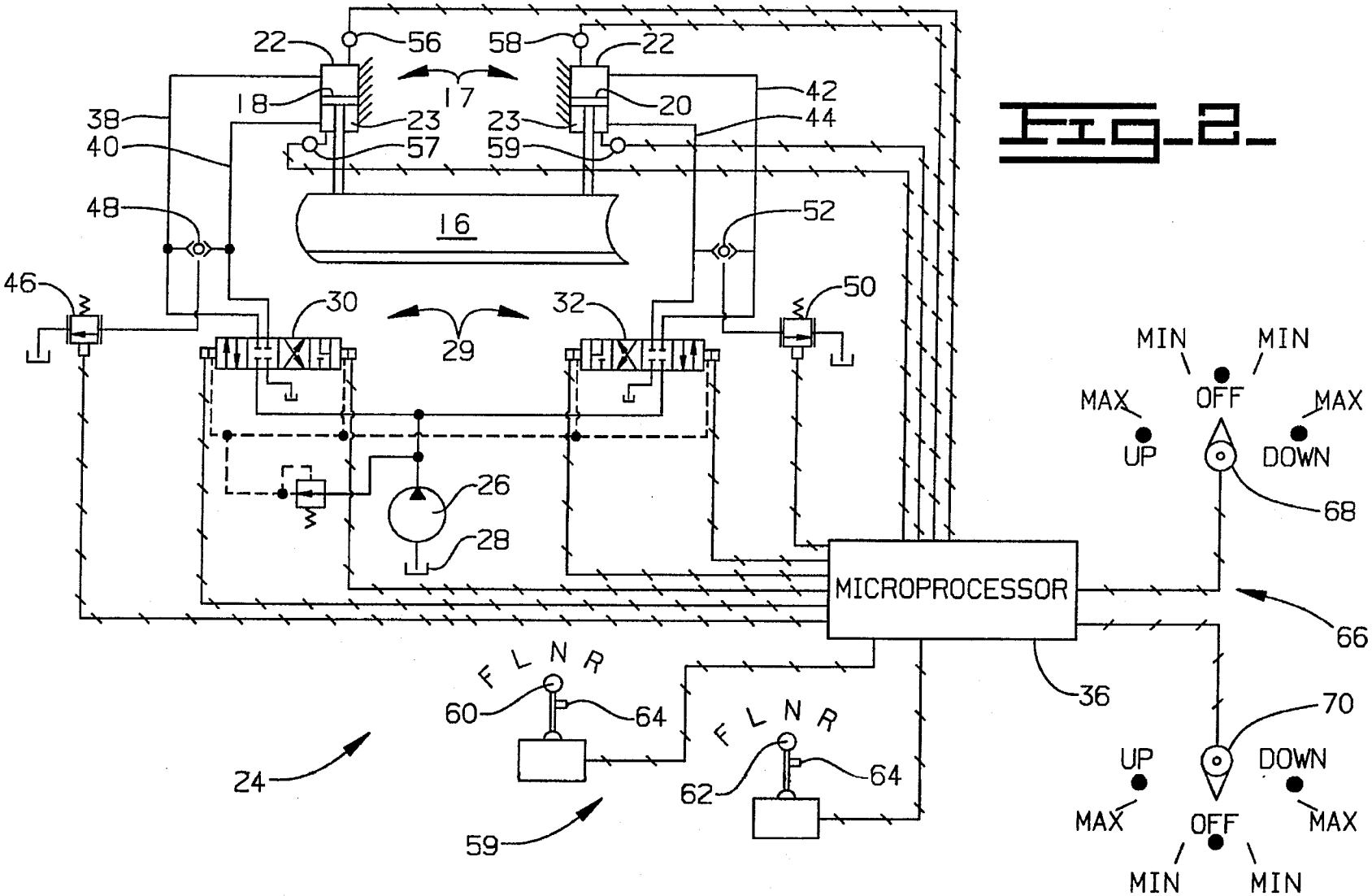
FIG. 2 is a partial schematic and partial diagrammatic illustration of an electro-hydraulic system incorporating the subject invention.

Referring to FIG. 2, an electro-hydraulic system 24 is schematically illustrated for controlling the blade 16. The electro-hydraulic system 24 includes a source of pressurized fluid, such as a variable displacement pump 26, which receives fluid from a reservoir 28 and delivers the pressurized fluid to an actuator arrangement 17, such as the respective first and second actuators 18,20, through an electro-hydraulic directional control valve arrangement 29, such as respective first and second electro-hydraulic directional control valves 30,32. Each of the first and second electro-hydraulic directional control valves 30,32 is movable from a closed, neutral (N) position toward first and second operative positions (R,L) and a float (F) position in a well known manner responsive to receipt of an electrical signal from a microprocessor 36.

The first electro-hydraulic directional control valve 30 is connected to respective head and rod ends 22,23 of the first actuator 18 by conduits 38,40. The second electro-hydraulic directional control valve 32 is connected to respective head and rod ends 22,23 of the second actuator 20 by conduits 42,44. A first variable pressure relief valve 46 is connected through a first shuttle valve 48 to the conduits 38,40 and the relief settings thereof is controlled in response to a first electrical signal received from the microprocessor 36. A second variable pressure relief valve 52 is connected through a second shuttle valve 50 to the conduits 42,44 and the relief settings thereof is controlled in response to a second electrical signal received from the microprocessor 36. Each of the first and second shuttle valves 48,52 is operative to direct the highest pressure signal, in a well known manner, from the associated conduits 38,40 and 42,44 to the respective variable relief valves 46,50. Each of the first and second variable relief valves 46,50 is connected to the reservoir 28 in a conventional manner.

A first pressure sensor 56 is connected to the head end 22 of the first actuator 18 and an electrical signal representative of the pressure therein is delivered to the microprocessor 36. A second pressure 57 is connected to the rod end 23 of the first actuator 18 and an electrical signal representative of the pressure therein is delivered to the microprocessor 36. A third pressure sensor 58 is connected to the head end 22 of the second actuator 20 and an electrical signal representative of the pressure therein is delivered to the microprocessor 36. A fourth pressure sensor is connected to the rod end 23 of the second actuator 20 and an electrical signal representative of the pressure therein is delivered to the microprocessor 36.

The electrical signals from the microprocessor 36 that activate the respective first and second electro-hydraulic directional control valves 30,32 are generated in response to movement of a control lever mechanism 59, such as respective control levers 60,62, that is electrically connected to the microprocessor 36. It is recognized that both of the first and second electro-hydraulic directional control valves 30,32 could be controlled by one control lever without departing from the essence of the subject invention. Movement of the respective control levers 60,62 is initiated by a machine operator between the respective neutral (N), raise (R), lower (L), and float (F) positions. The degree of movement of the respective control levers 60,62 in a given direction is electrically transmitted to the microprocessor 36 and determines the magnitude of the electrical signal being delivered from the microprocessor 36 to the respective first and second electro-hydraulic directional control valves 30,32. As noted above, the respective first and second electro-hydraulic directional control valves 30,32 are moved in proportion to the electrical signal received from the microprocessor 36.

Each of the control levers 60,62 has a switch 64 mounted thereon and electrically connected to the microprocessor 36. Depressing either of the switches 64 and moving the associated control lever 60/62 conditions the microprocessor 36 to simultaneously send the same electrical signal, that represents movement of the one control lever 60/62, to both of the first and second electro-hydraulic directional control valves 30,32. Consequently, movement of only one of the control lever 60/62 results in both actuators 18,20 moving together and at the same rate of speed. The same results occur if the other of the switches 64 is depressed and the associated lever 60/62 is moved. If both of the switches 64 are depressed at the same time, the control levers 60,62 operate independent of each other to individually control the respective actuators 18,20 in a typical manner.

A variable force control 66 is provided and is electrically connected to the microprocessor 36. The variable force control 66 includes first and second pressure selector knobs 68,70. Each of the first and second pressure selector knobs 68,70 is movable from an "OFF" position towards an "UP" position or a "DOWN" position. The magnitude of the pressure setting is increased by moving the respective selector knobs 68,70 from the "OFF" position towards the "UP" or "DOWN" positions. In order to utilize the variable force control 66 solely for bounce control, a single on/off switch could be provided to condition the electro-hydraulic system for bounce control.

It is recognized that various forms of the electro-hydraulic system could be utilized without departing from the essence of the invention. For example, even though sensing of the pressures in the head and rod ends 22,23 of the first and second actuators 18,20 are illustrated and described, it is recognized that sensing the extended position of the respective actuators 18,20 could be utilized. Likewise even though different pressure selector knobs 68,70 are illustrated, the subject electro-hydraulic system 24 could use only one pressure selector knob to control the force being subjected to the blade 16 by the actuators 18,20.

Industrial Applicability.

In the operation of the machine 10 shown in FIG. 1 and the electro-hydraulic system 24 illustrated in FIG. 2, the operator makes an input to both of the control levers 60,62 in the same direction in order to move the blade 16. If the operator moves both of the control levers 60,62 towards the "R" or raise position, electrical signals proportional to the degree of movement of the respective control levers 60,62 are directed to the microprocessor 36. The received signals from the respective control levers 60,62 are processed to identify the magnitude of the signal and direction of lever movement. Respective electrical signals proportional to the received signals from the first and second levers 60,62 are delivered to the respective electro-hydraulic directional control valves 30, 32 to proportionally move the respective directional valves 30,32 thus directing pressurized fluid from the pump 26 to the rod ends 23 of the respective actuators 18,20 to raise the blade 16. In order to lower the blade 16, the operator moves the respective control levers 60,62 towards the "L" or lower position. Electrical signals representative of the position of the respective control levers 60,62 are directed to the microprocessor 36 and the microprocessor 36 directs proportional signals to the respective electro-hydraulic directional control valves 30,32 which directs pressurized fluid to the head ends 22 of the actuators 18,20 to lower the blade 16. As is well known, the blade 16 can be placed in a "float" position by moving the respective control levers 60,62 to the "F" or float position. In the float position, the head and rod ends 22,23 of the respective actuators 18,20 are interconnected to each other and to the reservoir 28. In this position, the blade 16 is permitted to slide or float along the top of the work surface without having any down force, other than the weight and associated components of the blade 16, being applied thereto.

From those skilled in the art, it is recognized that one side of the blade 16 can be raised higher or lower than the other side by moving only one of the control levers 60,62 or by moving one of the control levers 60,62 more or less than the movement of the other one of the control levers 60,62. Naturally this depends on the operation being performed by the machine.

As described above, raising or lowering of the blade 16 requires movement of both of the control levers 60,62 at the same time. As is well known, movement of both of the control levers 60,62 at the same time requires the operator to use both hands. In the subject arrangement, movement of one the control levers 60,62 can result in both of the actuators 18,20 moving at the same time and at the same rate. In order to move both actuators 18,20 at the same time, the operator merely depresses one of the switches 64 on one of the control levers 60/62. For example, when the operator depresses the switch 64 on the control lever 60, an electrical signal is directed to the microprocessor 36 to condition the microprocessor 36 so that on subsequent movement of the control lever 60 simultaneous signals are directed to both of the electro-hydraulic directional control valves 30,32. These simultaneous signals are proportional to the movement of the one control lever 60. Likewise, if the operator depresses the other switch 64 on the second control lever 62, simultaneous signals, that are proportional to the movement of the second control lever 62, are directed to both of the electro-hydraulic directional control valves 30,32. This allows the operator to use only one hand to raise or lower the blade 16 thus freeing the other hand for other operations such as steering the machine, shifting the gears of the transmission, etc.

In the event both of the switches 64 are depressed at the same time and both of the levers 60,62 are moved at the same time, the microprocessor 36 functions to send only individual signals to the respective electro-hydraulic directional control valves 30,32.

In order to provide a constant force on the blade 16 in a downward or upward direction, the variable force control 66 is used. The operator moves the respective selector knobs 68,70 to a desired position which relates to a pressure operating level. As noted above, this operating pressure level can be varied from a minimum pressure level to a maximum pressure level. It is recognized that one selector knob 68/70 could be placed in a different position than the other in order for more force to be applied to one side of the blade 16 as compared to the other side thereof. Once the operator moves the respective selector knobs 68,70 to their desired positions, the selected positions are electrically transmitted to the microprocessor 36. The microprocessor 36 transmits an electrical signal to the first and second electro-hydraulic directional control valves 30,32 in order to direct pressurized fluid from the variable pump 26 through the respective first and second electro-hydraulic directional control valves 30,32 to the head ends 22 of the first and second actuators 18,20. The blade 16 is moved downwardly into contact with the work surface at a rate of speed as determined by the electrical signal being delivered to the first and second electro-hydraulic directional control valves 30,32 from the microprocessor 36. Simultaneously an electrical signal is transmitted from the microprocessor 36 to each of the variable pressure relief valves 46,50 thus setting their effective operating pressure. The setting of the variable pressure relief valves 46,50 is proportional to the respective settings of the selector knobs 68,70. The position of the selector knob 68 relates to the setting of the first variable pressure relief valve 46 and the position of the selector knob 70 relates to the setting of the second variable pressure relief valve 50.

Since the weight of the blade 16 and other associated structure may produce a force against the work surface higher than desired, the operator may set the respective selector knobs 68,70 at a position towards "UP". In this instance, the pressurized fluid from the variable pump 26 is directed to the rod end 23 of the respective actuators 18,20 to urge the actuators 18,20 upwardly. However, the pressure level is maintained at a level low enough not to lift the blade 16 from the work surface but large enough to subtract from the force of the total weight of the blade 16 and its associated components acting on the work surface. As noted above, the pressure setting of the first and second variable pressure relief valves 46,50 are set according to the selected position of the respective selector knobs 68,70.

Movement of either of the control levers 60,62 interrupts the variable force control 66. In order to restart the variable force control 66, the respective selector knobs 68,70 must be returned to their "OFF" positions and if desired moved back to a desired constant force position.

During a normal blading operation with the blade in a fixed position and the actuators 18,20 locked in the fixed position, and the machine encounters a bump or hard area the work element or blade 26 may start s to bounce or lope. When the bounce starts, the pressure level in the respective actuators 18,20 varies. As noted above, during any blading operation, the first, second, third and fourth pressure sensors 56,58 are continuously sensing the pressures in the respective head and rod ends 22,23 of each of the actuators 18,20 and delivering an electrical signal representative of the sensed pressures therein to the microprocessor 36. In one embodiment, the microprocessor 36 is continually monitoring the peak to peak pressure levels therein and comparing the peak to peak pressures to a predetermined threshold level. The predetermined threshold level can be determined in several ways. For example, peak to peak pressures in only the head ends 22 of each actuator 18,20 could be sensed and their respective electrical signals delivered to the microprocessor 36 or peak to peak pressures in only the rod ends 23 of each actuator 18,20 could be sensed and their respective electrical signals delivered to the microprocessor 36. Furthermore, the peak to peak pressures of the difference in pressure between the head and rod ends 22,23 of each of the actuators 18,20 could be determined by the microprocessor 36 and used as the threshold pressure level. Each of the above noted ways of determining the threshold pressure level could be utilized without departing from the essence of the invention.

If the predetermined threshold level is exceeded, as would occur if the blade 56 starts to bounce, the variable force control 66 is automatically adjusted or turned on to a predetermined level or to a position equal to the average of the threshold pressure level. As noted above, this adjusts the position, if needed, of the first and second electro-hydraulic directional control valves 30,32 and sets the first and second variable relief valves 46,50 to a predetermined level or to the average of the threshold pressure level. Once the variable force control is turned on to control the bounce, the actuators are allowed to move up or down in a controlled manner. The variable force control 66 is active for a predetermined period of time or until the peak to peak pressures are within the threshold pressure level. Preferably, the variable force control 66 is not turned off until a second smaller predetermined threshold pressure level is attained. Once the bounce has been eliminated and the variable force control 66 has been turned off, the actuators 18,20 are once again locked since the first and second electro-hydraulic directional control valves 30,32 have been returned to their centered, flow blocking position. At the same time the first and second variable relief valves 46,50 are set to their maximum pressure levels to effectively prevent flow to the reservoir 28. It is recognized that an electrically controlled blocking valve could be placed in the lines between the respective shuttle valves 48,52 and the variable relief valves 46,50 in order to block the flow therethrough instead of setting the variable relief valves 46,50 to their maximum positions.

The bounce of the blade 26 is effectively eliminated by sensing and controlling the peak to peak pressures within the respective actuators 18,20. Furthermore, by sensing the above normal threshold pressure level early, the bounce can be eliminated at substantially the same time that it starts thus eliminating any scalloping or roughness to the work surface.

In another embodiment, the microprocessor 36 applies the Goertzel algorithm to detect the bounce. The output of the Goertzel algorithm is compared with a predetermined threshold level. If the output exceeds the predetermined threshold level then the bounce is detected and the variable force control 66 is turned on to eliminate the bounce.

Thus the method for controlling the bounce of a work implement attached to a machine having an electro-hydraulic system includes the steps of detecting the initiation of a bounce between the work element and the work surface and altering the pressure in the actuator arrangement disposed between the frame and the work implement to eliminate the bounce. The step of detecting the initiation of the bounce includes the steps of continuously monitoring the operating pressure level in the actuator arrangement and delivering electrical signals representative thereof to a microprocessor. The microprocessor establishes a predetermined threshold pressure level based on the sensed peak to peak pressures. The step of altering the pressure level in the actuator arrangement includes the steps of establishing a predetermined pressure level in the actuator arrangement by connecting a variable pressure relief valve to the actuator arrangement and controlling the setting thereof to establish a pressure level therein that is equivalent to the average of the peak to peak pressure in the threshold pressure level. The method further includes the step of turning off or resetting the system once the bounce has been eliminated and/or the initial threshold pressure level has been reestablished.

In view of the foregoing, it is readily apparent that the subject method for controlling the bounce of a work implement attached to a machine effectively eliminates the bounce of the work implement or blade substantially at the same time that it starts. The subject method substantially eliminates any unwanted up and down movement of the blade relative to the work surface by continuously monitoring the pressure in the actuators 18,20 and controlling the variations of the pressures therein within a predetermined threshold level.

Other aspects, objects and advantages of the invention can be obtained from a study of the drawings, the disclosure and the appended claims.

We claim:

1. A method for controlling bounce of a work implement relative to a work surface subsequent to the initiation of a bounce, the work implement being attached to a machine having an electro-hydraulic system, the electro-hydraulic system includes a microprocessor, an actuator arrangement connected between the machine and the work implement, a source of pressurized fluid that receives fluid from a reservoir, an electro-hydraulic directional control valve arrangement disposed between the source of pressurized fluid and the actuator arrangement, and a control lever mechanism electrically connected to the microprocessor and operative to direct pressurized fluid to the actuator arrangement by controlling movement of the electro-hydraulic directional control valve arrangement, the method comprises the steps of:

detecting the initiation of the bounce of the work member relative to the work surface by sensing the operating pressure in the actuator arrangement; and altering the pressure level in the actuator arrangement to eliminate the bounce.

2. The method of claim 1 wherein in the step of detecting the initiation of the bounce includes detecting a predetermined minimum peak to peak pressure variation in the actuator arrangement and establishing the predetermined minimum peak to peak pressure variation as an operating threshold level.

3. The method of claim 2 wherein in the step of altering the pressure level in the actuator arrangement the operating threshold level is continuously monitored and in the event the threshold pressure level is exceeded during use the pressure level in the actuator arrangement is altered.

4. The method of claim 3 wherein in the step of altering the pressure level in the actuator arrangement a predetermined pressure level is established therein to eliminate the bounce of the work member.

5. The method of claim 4 wherein in the step of altering the pressure level in the actuator arrangement the pressure level in the actuator arrangement is altered by connecting a variable pressure relief valve to the actuator arrangement and controlling the setting thereof to establish a pressure level therein that is equivalent to the average of the operating threshold level.

6. The method of claim 5 wherein in the step of altering the pressure level the bounce control is turned off once the bounce has been eliminated.

7. The method of claim 5 wherein the actuator arrangement includes first and second actuators and the electro-hydraulic directional control valve arrangement includes first and second electro-hydraulic directional control valves, and the microprocessor senses the operating pressure in the first and second actuators and in the step of detecting the initiation of a bounce the operating pressure in the first and second actuator are monitored to establish the operating threshold level therein and in the step of altering the pressure level, the pressure level in the first and second actuators are altered to re-establish the threshold operating level therein in the event the operating threshold level is exceeded during use.

8. The method of claim 7 wherein the variable pressure relief valve is connected to the first actuator and including a second variable pressure relief valve connected to the second actuator and in the step of altering the pressure level in the actuator arrangement the pressure level in the first and second actuators are altered by setting the pressure levels thereof equivalent to the average of the operating threshold level.

9. The method of claim 8 wherein each of the first and second actuators have a head end and a rod end and in the step of detecting the initiation of the bounce the microprocessor is sensing the pressure level in the head ends of the first and second actuators.

10. The method of claim 9 wherein in the step of altering the pressure level the bounce control is turned off once the bounce has been eliminated.

11. The method of claim 8 wherein each of the first and second actuators has a head end and a rod end and in the step of detecting the initiation of the bounce the microprocessor is sensing the pressure level in the rod ends of the first and second actuators.

12. The met-hod of claim 8 wherein each of the first and second actuators has a head end and a rod end and in the step of detecting the initiation of the bounce the microprocessor is sensing the differential pressure between the rod and head ends of the first and second actuators.

* * * * *

UNITED STATES PATENT AND TRADEMARK OFFICE

CERTIFICATE OF CORRECTION

PATENT NO. : 5,622,226

DATED : April 22, 1997

INVENTOR(S) : Dennis J. Hausman et al.

It is certified that error appears in the above-identified patent and that said Letters Patent is hereby corrected as shown below:

Please change Michael I. Cline's city from "Metamore" to --Metamora--

Claim 7, column 8, line 14, -threshold operating- should read:

-- operating threshold --.

Claim 12, column 8, line 38, delete "met-hold" and insert --method--

Signed and Sealed this

Seventh Day of October, 1997

*Attest:*

Bruce Lehman

BRUCE LEHMAN

*Attesting Officer*

*Commissioner of Patents and Trademarks*